US007021430B2

(12) United States Patent
Ring et al.

(10) Patent No.: US 7,021,430 B2
(45) Date of Patent: Apr. 4, 2006

(54) RELEASE HOLD MECHANISM FOR A HAND BRAKE HAVING A QUICK RELEASE MECHANISM

(75) Inventors: Michael E. Ring, Crown Point, IN (US); Howard Sommerfeld, Oak Forest, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/396,262

(22) Filed: Mar. 25, 2003

(65) Prior Publication Data

US 2004/0188195 A1 Sep. 30, 2004

(51) Int. Cl.
*B61H 13/00* (2006.01)

(52) U.S. Cl. ..... 188/33; 188/107; 74/505; 74/528

(58) Field of Classification Search ..... 188/33, 188/34, 107, 184, 185, 153 R, 180; 192/15, 192/16; 74/504, 505, 527, 528, 529, 531
See application file for complete search history.

(56) References Cited

U.S. PATENT DOCUMENTS

| | | | | |
|---|---|---|---|---|
| 3,988,944 | A * | 11/1976 | Klasing | 74/505 |
| 4,282,771 | A * | 8/1981 | Grube | 74/505 |
| 4,291,793 | A * | 9/1981 | Klasing | 74/505 |
| 4,714,142 | A * | 12/1987 | Shepherd | 188/185 |
| 6,364,428 | B1 * | 4/2002 | Labriola et al. | 188/33 |
| 6,474,450 | B1 * | 11/2002 | Ring et al. | 188/33 |

* cited by examiner

*Primary Examiner*—Thomas Williams
(74) *Attorney, Agent, or Firm*—James Ray & Assoc

(57) ABSTRACT

A hand brake mechanism having a release hold mechanism to prevent unwanted application of the railcar brakes. The release hold mechanism includes a cam and a holding pawl having cooperating force members and a detent retaining device engaging the cam disposed within the railcar hand brake to maintain the hand brake in the released hold condition. The cooperating force members disengage the cam from the detent retaining device to allow brake application. The hand brake incorporates an indicator member having a reflective coating to indicate such release hold position of the railcar hand brake.

17 Claims, 5 Drawing Sheets

RELEASE HOLD MECHANISM FOR A HAND BRAKE HAVING A QUICK RELEASE MECHANISM

FIELD OF THE INVENTION

The present invention relates, in general, to hand brake assemblies for use on railcars and, more particularly, this invention relates to a hand brake assembly with a quick release mechanism.

BACKGROUND OF THE INVENTION

Prior to the conception and development of the present invention, railway car hand brake mechanisms were generally well known in the art. They usually include a large, rotatable hand wheel disposed in a vertical plane and mounted on a shaft which, through a gear train, can rotate a chain drum to wind up a chain that is secured at its end remote from the chain drum to the brake rigging of the railway car. As the hand wheel is rotated in one direction, the brakes are applied and rotation of the hand wheel shaft in the opposite direction is prevented by a pawl which engages a detent wheel on the hand wheel shaft.

These hand brake mechanisms further provide a clutch mechanism for facilitating a gradual release of the brake. When a hand wheel is rotated clockwise (as viewed from the front of the unit), such rotation is transmitted directly through a drive shaft, a pinion, a gear, and a winding drum to take up slack of a chain connected to the brake rigging. When resistance is offered by the chain to further rotation of the hand wheel, such resistance, acting back through the drum, the gear, and pinion, causes a nut to be advanced on a threaded portion of the drive shaft to move against a ratchet member which is clamped between respective friction surfaces on the nut and on the drive shaft, thus causing the drive shaft, ratchet, and the nut to rotate as a unit. A pawl prevents rotation of the ratchet in the opposite direction. The hand wheel torque is increased until a state of static equilibrium is reached, or at the point at which the brakes are fully applied, whereupon rotation of the hand wheel is terminated, and the clamped ratchet, by means of the holding pawl, prevents the chain from unwinding.

The clutch mechanism also provides for quick release of the brakes by operating a release handle which effects disengagement of the normally engaged clutch and thereby allows free rotation of the pinion and gear to release the chain load while the nut and ratchet are held stationary by the holding pawl. The brakes may be released by disengaging the pawl from the detent wheel but this causes rapid rotation of the hand wheel and the gears of the gear train. To avoid rapid rotation of the hand wheel, hand brake mechanisms have been devised which are known as "quick release" mechanisms.

U.S. Pat. No. 4,714,142 titled Railway Car Hand Brake with Release Governor teaches such a hand brake having a quick release mechanism. The quick release mechanism includes a cam mounted on a manually pivotable shaft substantially attached to a quick release handle. During quick release, rotation of the quick release lever rotates the cam which engages a crank and forces it to move downwardly and disengage the pinion from the clutch collar. With the pinion disengaged from the clutch mechanism, the holding pawl and detent gear can no longer prevent its rotation, therefore it rotates freely about the drive shaft causing quick release of the brakes without rotation of the hand wheel. Opposite movement of the quick release handle releases the clutch collar and forces the clutch collar to reengage the pinion under the force of the spring acting on such collar and allow for a normal brake application.

The teachings of the U.S. Pat. No. 4,714,142 are hereby incorporated in present application by reference thereto.

In order for the quick release mechanism to function properly, the quick release lever, rotatable approximately 30 degrees to release the brake, must be held in the released position until the entire chain has been expelled. It has been found that when a hand brake is quick released using the lever, the lever is not left in its full released position long enough to fully expel the chain from the hand brake, thus maintaining residual tension due to lack of sufficient slack. As a result the bakes may be applied unintentionally during railcar motion, especially around the curve.

As it can be seen from the above discussion, prior to the instant invention, there has been a need for a positive means for maintaining the quick release mechanism in the released hold position to avoid unintentional application of the railcar brake rigging.

SUMMARY OF THE INVENTION

A hand wheel in a handbrake mechanism for a railway car is used to rotate a gear wheel to apply the brakes. Such hand brake having a housing with a back wall and a front wall, with a chain winding drum and a main gear wheel rotatably mounted on a drum shaft thereon. There is a hand wheel having a shaft rotatably mounted on the housing and having a bearing section at a first end and a hand wheel receiving section on a second end external to such housing. A ratchet wheel is mounted on the hand wheel shaft and rotatable with such hand wheel shaft intermediate the first and second ends thereof. A holding pawl in such housing cooperates with the ratchet wheel so as to prevent reverse rotation thereof. Additionally, a freely rotatable second pinion gear on the hand wheel shaft engages the main gear wheel, such pinion having a radially extending flange cooperating therewith. A crank is pivotally mounted within the hand brake housing and has a pair of fingers engaging the collar of the clutch mechanism. A quick release mechanism cooperates with the holding pawl to allow reverse rotation of the ratchet wheel for releasing the chain. The hand brake incorporates a release hold mechanism of the preferred embodiment having a release shaft attached to a quick release lever at one end. The release shaft has a cam attached to its other end. The cam has a force receiving portion which cooperates with the force transmitting portion of the holding pawl. To quick release the brakes, rotation of the release shaft causes rotation of the cam and enables fingers of the crank to axially move the collar and disengage a second pinion gear from the main gear. At least one detent is disposed within the hand brake housing which engages the detent portion of the cam to maintain the quick release mechanism in the release and hold position. To reapply brakes, rotation of the hand wheel in the brake applied direction trips the holding pawl causing the cam to disengage from the detent position and enabling the collar to reengage the second pinion gear from the force of the spring within the clutch.

OBJECTS OF THE INVENTION

It is therefore one of the primary objects of the present invention to provide a hand brake having a means to maintain the hand brake in the release hold position.

Another object of the present invention is to provide a hand brake assembly which prevents unintentional application of the railcar brake rigging.

Still another object of the present invention is to provide a hand brake having a means to re-engage the clutch mechanism after a quick release of the brake.

An additional object of the present invention is to provide a hand brake having a means to visually indicate such hand brake is in a release hold position.

These and various other objects and advantages to the present invention will become more readily apparent to those persons skilled in the relevant art from the following more detailed description of the invention, particularly, when such description is taken in conjunction with the attached drawing Figures and with the appended claims.

DETAILED DESCRIPTION OF THE INVENTION

Figure 1:
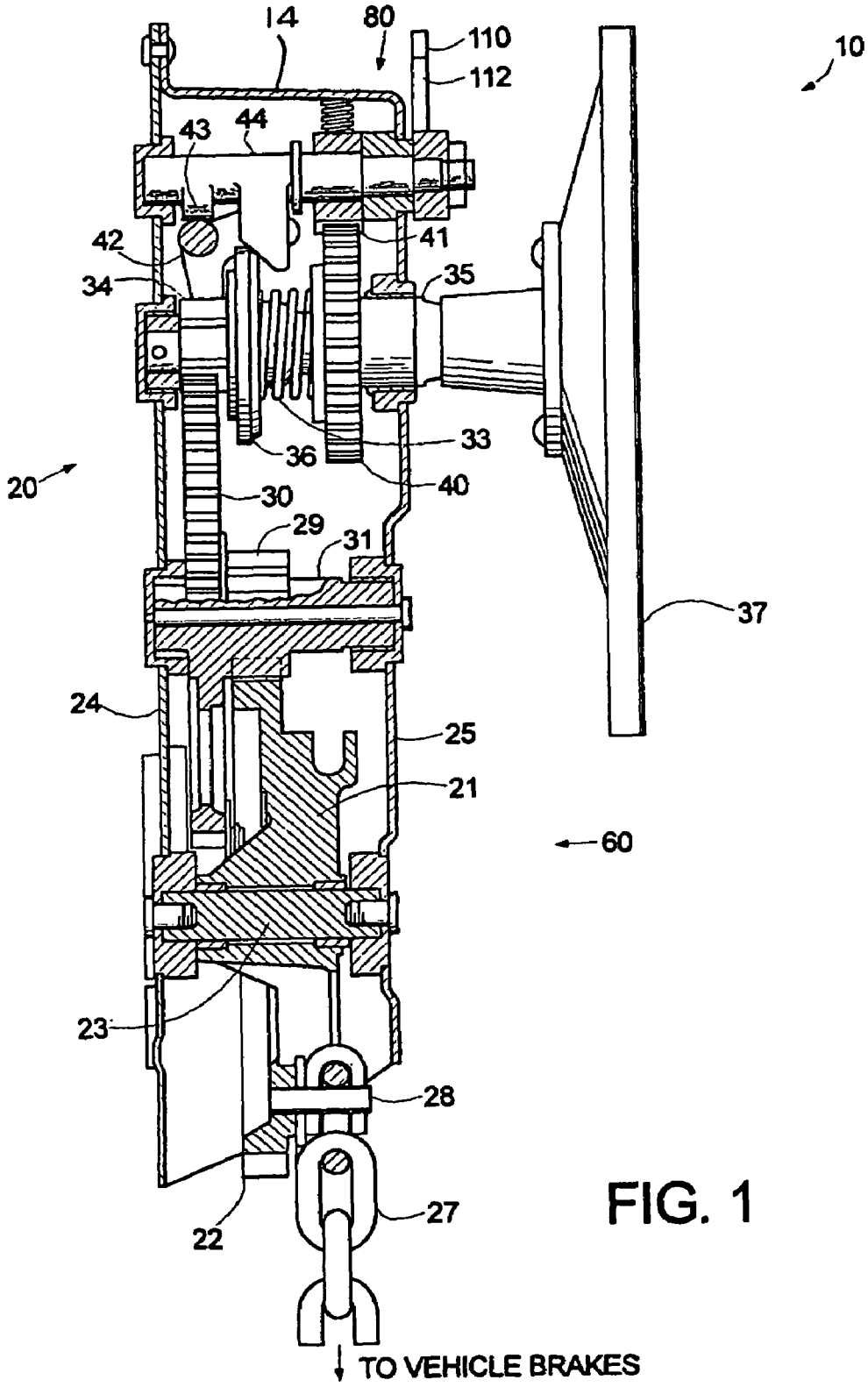
FIG. 1 is a cross-sectional view of the hand brake.

Prior to proceeding to the more detailed description of the various embodiments of the present invention, for the sake of clarity and understanding of such invention, it should be noted that identical components having identical functions have been identified with identical reference numerals throughout each of the figures illustrated herein.

A hand brake mechanism, generally designated 10, includes a chain drum 21 rotatable by a gear 22. The drum 21 is rotatably mounted on a shaft 23 which is secured to the housing back plate 24 and the housing front plate 25. One end of a chain 27 is secured to the drum 21 by a pin 28, and the other end of the chain 27 is secured to the railcar brake rigging so that when the chain 27 is wound up on the drum 21, the brakes of the railcar are applied to at least limit movement of the railcar.

The teeth of a first pinion gear 29, engage the teeth of the gear 22. The first pinion gear 29 is integral with a gear 30 and a shaft 31, so that when the gear 30 is rotated, the first pinion gear 29 and the shaft 31 rotate which causes the gear 22 and the drum 21 to rotate.

Figure 3:
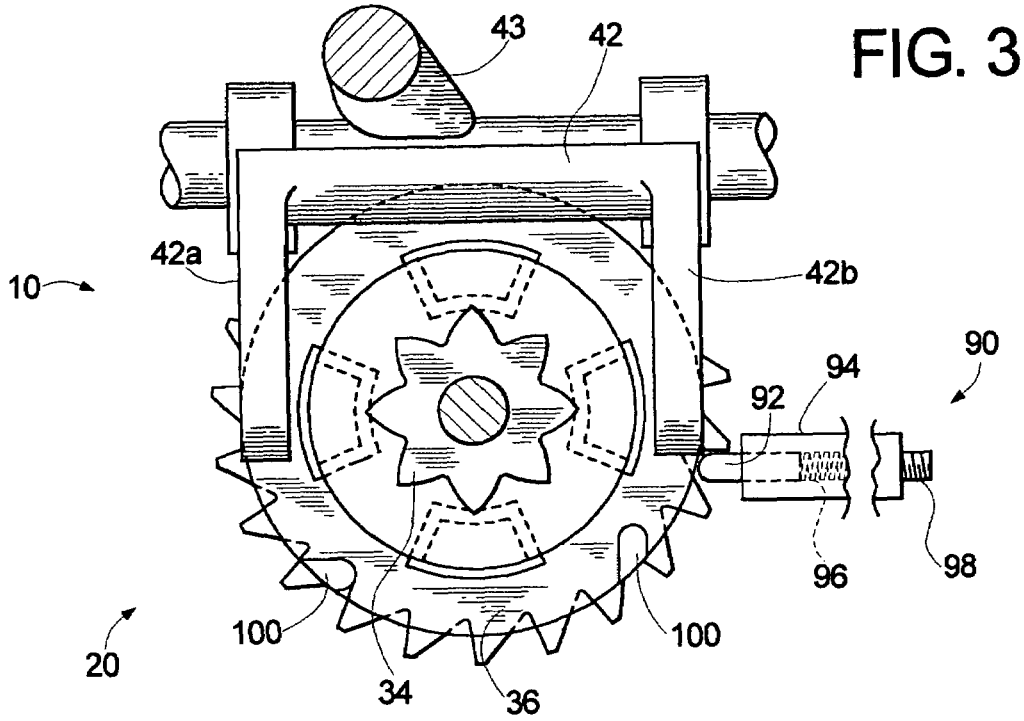
FIG. 3 is partial planar view of the hand brake, particularly showing the release hold mechanism of an alternative embodiment.
Figure 4:
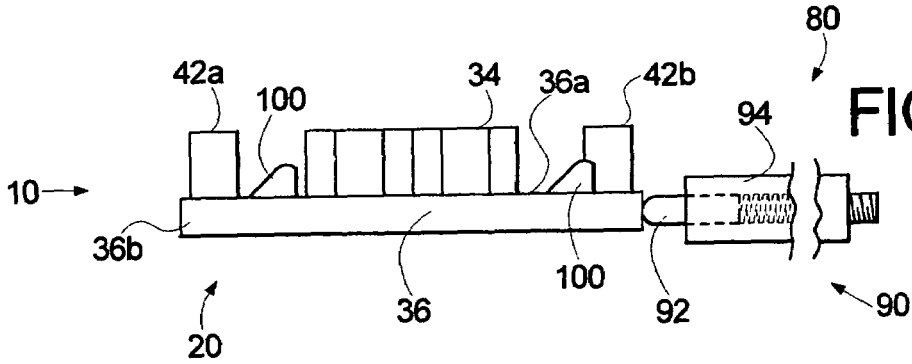
FIG. 4 is a partial elevation view of a hand brake assembly of the present invention as illustrated in FIG. 3, particularly showing the second pinion gear and the clutch collar in the applied position.
Figure 5:
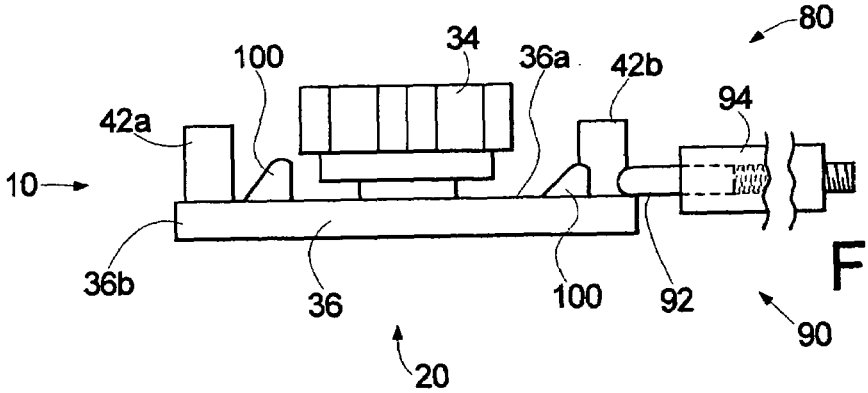
FIG. 5 is a partial elevation view of a hand brake assembly of the present invention as illustrated in FIG. 3, particularly showing the second pinion gear and the clutch collar in the release hold position.

The teeth of a second pinion gear 34 are positioned to engage the teeth of the gear 30 so that a rotation of the second pinion gear 34 causes rotation of the gear 30. The second pinion gear 34 is freely rotatable on a shaft 35 when it is not held by a clutch collar 36 which is secured to the shaft 35 so as to rotate therewith. The shaft 35 is rotatable by a hand wheel 37. As best shown in FIGS. 3, 4, and 5, the clutch collar 36 preferably has at least one detent release portion 100 disposed within a planar surface portion 36*a*.

A detent or ratchet wheel 40 is mounted on the shaft 35 and cooperates with a clutch mechanism, generally designated 20, and with a holding pawl 41 which is free to ratchet thereon upon rotation of such ratchet wheel 40 in a clockwise direction so that when the hand wheel 37 is rotated in the brake applying direction, the second pinion gear 34 and the hand wheel 37 cannot rotate in the reverse direction under the tension of the chain 27. However, the brakes may be released, after application, in small increments by rotating the hand wheel 37 in the direction opposite to the brake applying direction. In the preferred embodiment, the holding pawl 41 has a force transmitting portion 82 disposed outwardly in the direction of the cam 43.

Figure 2:
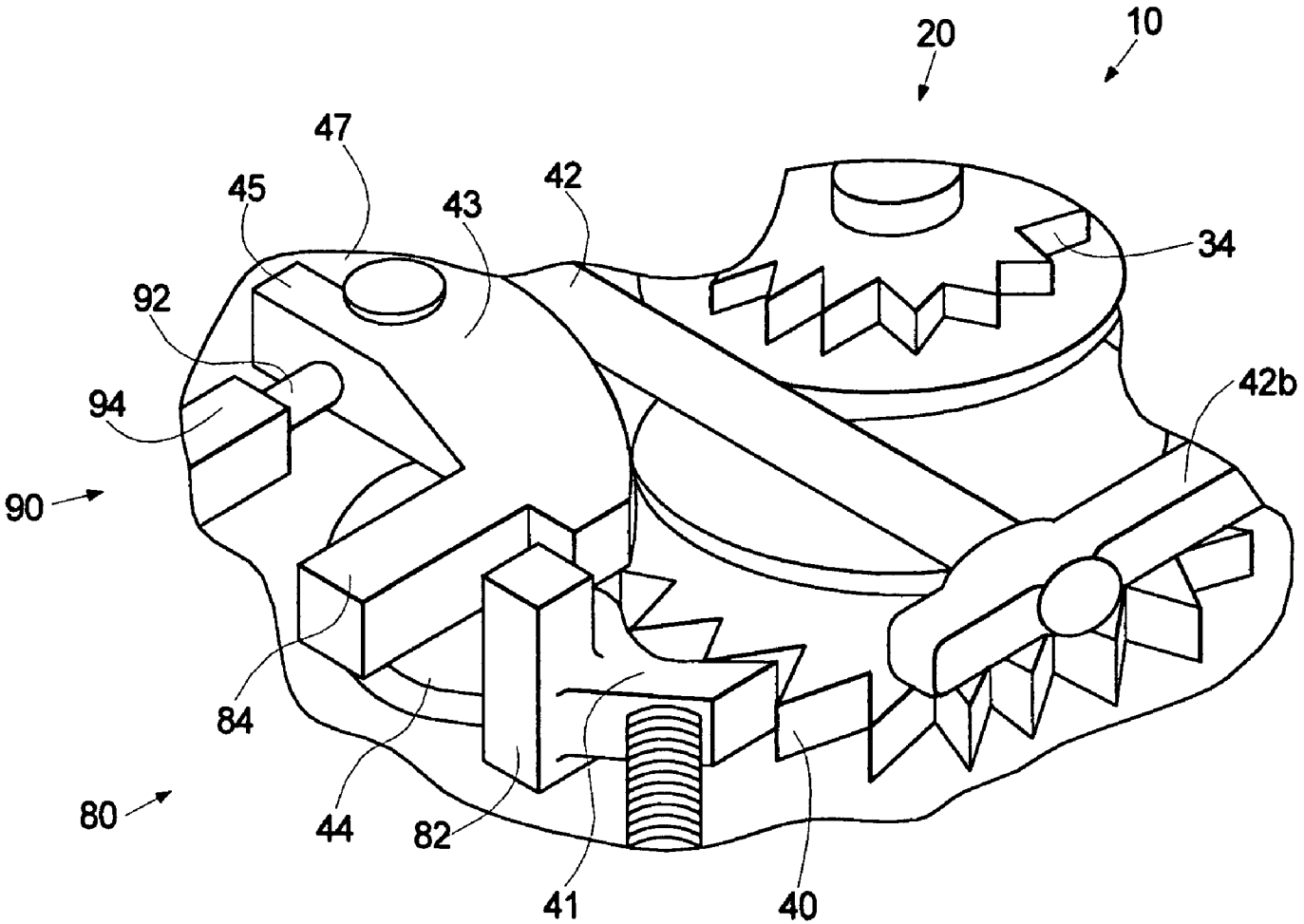
FIG. 2 is a partial perspective view of the hand brake, particularly showing the release hold mechanism of the preferred embodiment.

In a particular reference to FIG. 2, there is shown a release hold mechanism, generally designated 80, of the presently preferred embodiment comprising a cam 43 mounted on a manually pivotable release shaft 44, which cooperates with crank 42 having fingers 42*a* and 42*b* so that when the release shaft 44 is pivoted, the fingers 42*a* and 42*b* axially move the clutch collar 36 thereby releasing the second pinion gear 34 from the clutch collar 36 and enabling the second pinion gear 34 to rotate freely on the shaft 35. The cam 43 having a force receiving portion 84 cooperating with the force transmitting portion 82 of holding pawl 41 and a detent portion 45 cooperating with the detent 92 and stop 47.

At least one detent retaining means, generally designated 90, is disposed within hand brake 10. The at least one detent retaining means 90 has a detent 92 preferably engaging a detent portion 45 of the cam 43 with the brake in the released and hold condition. In the presently preferred embodiment, the at least one detent retaining means 90 further comprises a detent housing 94 substantially attached to the housing front plate 25. A detent 92 is movably disposed within the housing 94, protruding beyond the housing 94 and is biased by the bias spring 96 toward the detent position. It is further preferred that adjustment means 98 disposed adjacent bias spring 96 are provided to very the protrusion of the detent 92 and, more particularly, set the predetermined force of the at least one detent retaining means 90 to allow for component wear and overall tolerances of the hand brake and to provide substantial engagement of the cam 43 while brakes are in a released and hold condition while allowing release of such cam 43 to apply the brakes.

Alternatively the at least one detent means 90 can be of the variety of mechanical, pneumatic, hydraulic or electrical detent means mounted internally and/or externally of the hand brake housing 14. For example, such at least one detent means 90 can comprise a cylinder having a detent portion disposed at the end of the cylinder rod and receiving a fluid pressure signal to extend such rod in order to positively retain the cam 43 and receiving yet another fluid pressure signal to retract such rod at the beginning of the brake application cycle. Yet alternatively, the cylinder can be an electrical solenoid having similar interfaces.

Additionally, a leaf spring 120 of a predetermined strength can be attached at a predetermined position within the housing 14 engaging the detent portion 45 of the cam 43 to exert a predetermined force onto the cam 43.

With further reference to FIG. 2, should it become desirable to release the brakes quickly after they have been applied, the release shaft 44 is pivoted in a clock wise direction permitting the second pinion gear 34 to rotate, and thereby permitting rotation of the gears 22, 29 and 30 and the drum 21, under the tension of the chain 27. During such rotation the detent 92 moves to the opposite surface of the detent portion 45 thus preventing the cam 43 to return to its applied position against the stop 47.

Yet another alternative embodiment of the release hold mechanism 80 is illustrated in FIGS. 3, 4, and 5. In a particular reference to FIG. 3, at least one detent means 90 are disposed adjacent the clutch collar 36 and the detent 92 engages the side surface 36*b* of the collar 36, best shown in FIG. 4. If it is desired to release the brakes quickly after they have been applied, upon rotation of release shaft 44 by way of a release lever (not shown), the fingers 42*a* and 42*b* axially move the clutch collar 36 and thereby release the second pinion gear 34 from the clutch collar 36 and enable the second pinion gear 34 to rotate freely on the shaft 35. Axial movement of the clutch collar 36 enables the detent 92, normally engaging the collar side surface 36*b*, to move linearly and engage clutch collar planar surface 36*a*, best shown in FIG. 5, thus preventing return of the clutch collar 36 into the applied position. The release of clutch collar 36 may be accomplished by rotating the hand wheel 37 during brake application, enabling at least one detent releasing portion 100 disposed within the planar surface 36*a* to disengage the detent 92 from the planar surface 36*a* and further enable the clutch collar 36 to return to the applied position from the force of the spring 33 disposed within clutch mechanism 20.

It should be understood that detent 90 may engage at least a portion of the crank 42 in the release hold position and that such detent 90 may be disengaged by such modified at least one detent release portion 100 without departing from the intent of the present invention.

It will be further understood that at least one detent release portion 100 could be disposed within the surface of the ratchet wheel 40 adjacent the crank 42 and apply force on the crank 42 during the rotation of the hand wheel 37 to disengage crank 42 from the hold position to apply brakes.

The hand brake mechanism 10 may also include an indicator member 110, having a coating 112 applied thereto, attached to the outer end of the manually pivotable release shaft 44 to provide visual indication of the hand brake in the release hold position. Preferably, the coating 112 is a reflective tape easily recognizable from a distance.

Figure 6:
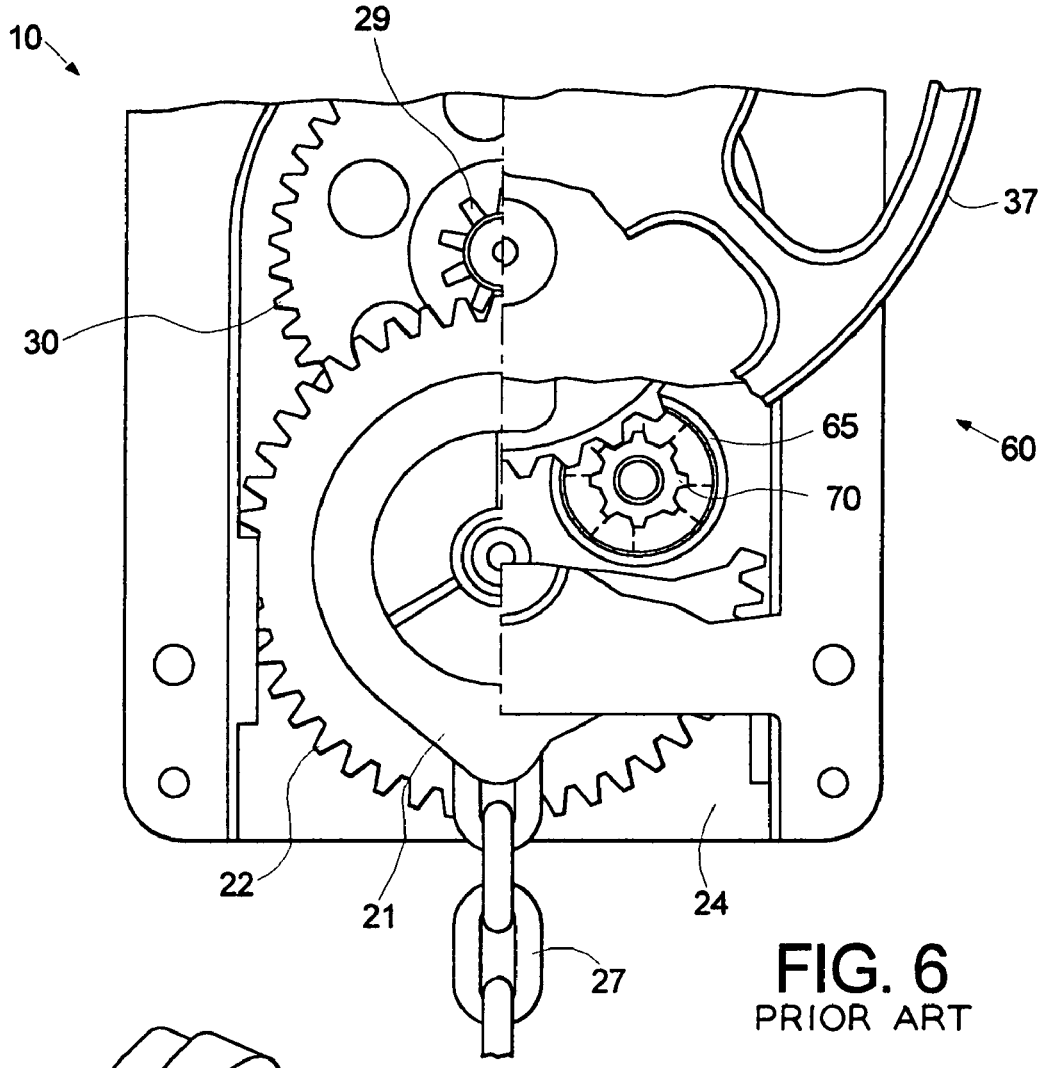
FIG. 6 PRIOR ART
FIG. 6 is a partial, front elevation view, with a portion of the cover cut away, of the present invention illustrated in FIG. 1.
Figure 7:
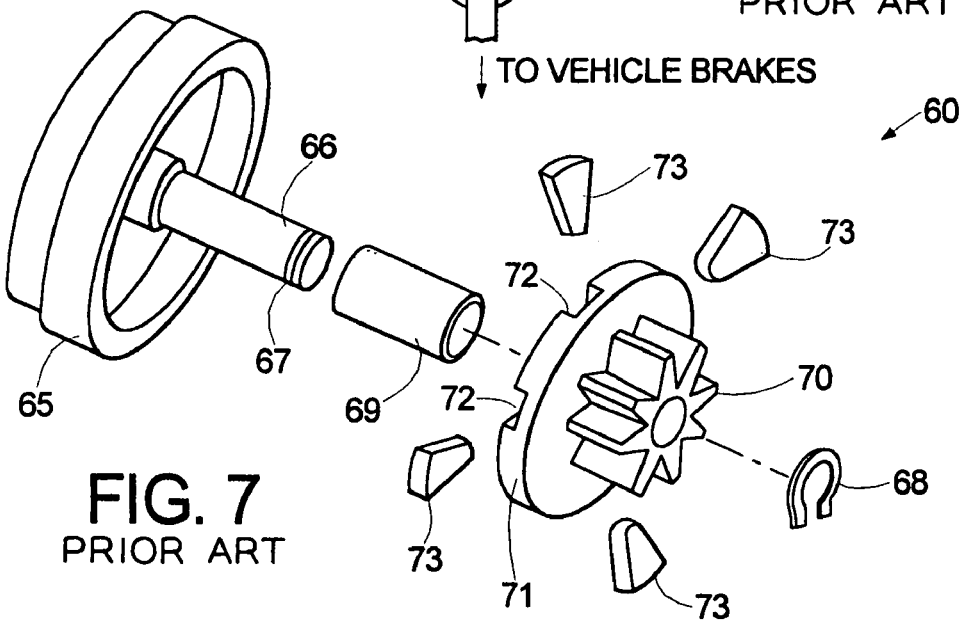
FIG. 7 PRIOR ART
FIG. 7 is an exploded view of the braking governor.
Figure 8:
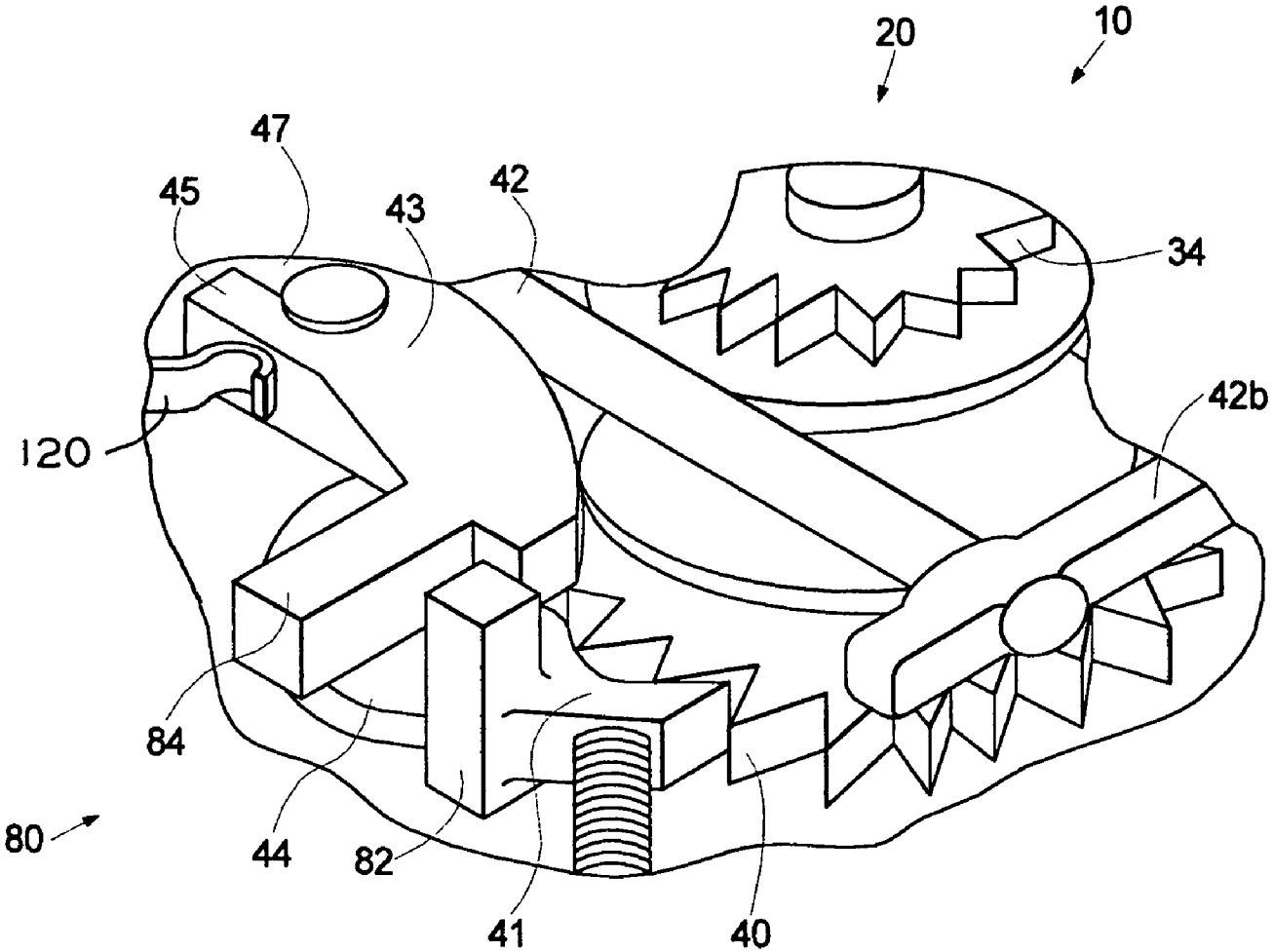
FIG. 8 is a partial perspective view of the hand brake, particularly showing the release hold mechanism of the alternative embodiment.

The hand brake mechanism 10 may further include a brake governor, generally designated 60, disposed intermediate gears 29 and 30, best illustrated in FIGS. 6 and 7.

The brake governor 60 is coupled to the gear 30 and provides a limited braking force which varies its retarding force dependent upon the speed of rotation of the gear 30. Thus, such brake acts as a governor and increases the retarding force with an increase of the speed of rotation of the gear 30 from a negligible value when the speed of rotation is low to a larger value which has no significant effect on the speed of rotation when the hand brake is first released.

The brake governor 60 comprises a hollow cylinder or braking drum 65 which is non-rotatably secured to the back plate 24. The drum 65 has a shaft 66 integral therewith, the shaft 66 having a groove 67 for receiving a retaining ring 68. The shaft 66 carries a cylindrical bearing 69 on which a gear 70 with a flange 71 having a plurality of wedge shaped slots 72, which are open at their radially outermost ends, is rotatably mounted. A plurality of brake shoes 73, one for each slot 72, are slidably received in, and substantially fill, the slots 72 between the collar 71 and the braking drum 65.

The teeth of the gear 70 mesh with the teeth of the gear 30 so that, depending upon the gear ratios, the gear 70 rotates approximately thirty-two times faster in the embodiment illustrated, than the drum 21 upon release of the railcar brakes. Such rate of rotation of the gear 70 causes the shoe 73 to be thrown outwardly by centrifugal force against the inner wall of the drum 65. By reason of the friction between the shoes 73 and the inner wall of the drum 65, there is a braking force applied to the gear 30 which, after release of the hand brake and the braking force on the chain 27 is substantially reduced, reduces the speed of rotation of the gears 22, 29, 30 and 34 and the chain drum 21, as compared to the speed of rotation thereof in the absence of the gear 70, shoes 73 and drum 65. Also, because of the gear ratios, a smaller braking force is required for retarding the rotation of the chain drum 21 than would be the case if the braking force were applied directly to the chain drum 21, such as by the gear 22.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A release hold mechanism for a railcar hand brake, said release hold mechanism comprising:

(a) a release shaft at least partially disposed within a hand brake housing for rotation thereof;

(b) a release lever attached to said release shaft;

(c) a cam mounted on one end of said release shaft, said cam having a force receiving portion and a detent portion;

(d) a holding pawl rotatably coupled to said release shaft, said holding pawl having a ratchet engaging portion and a force transmitting portion cooperating with said force receiving portion of said cam; and (e) at least one mechanical detent means disposed within said hand brake for cooperation with said detent portion of said cam to bias said cam in a release hold position for enabling full release of said hand brake, said at least one mechanical detent means is a detent movably disposed within a detent housing and urged by a bias spring to protrude beyond said detent housing in a direction of said cam with an adjustment means at least partially disposed internally within said detent housing adjacent said bias spring for varying protrusion of said detent beyond said detent housing for exerting a predetermined force onto said release shaft, a spring means attached to said hand brake housing and directly engaging said cam and an actuator selected from the group consisting of a pneumatic cylinder, a hydraulic cylinder and a solenoid.

2. A release hold mechanism according to claim 1, wherein said spring means directly engaging said cam is a leaf spring having a predetermined strength to exert said predetermined force onto said release shaft.

3. A release hold mechanism according to claim 1, wherein said pneumatic cylinder and said hydraulic cylinder have a detent retaining portion disposed at an end of a cylinder rod and receiving a fluid pressure signal to extend said rod in order to positively restrain said release shaft from rotational motion and receiving yet another fluid pressure signal to retract said rod at a beginning of a brake application cycle to allow rotational motion of said release shaft.

4. A release hold mechanism according to claim 1, wherein said solenoid has said detent retaining portion disposed at an end of a solenoid shaft and receiving an electrical signal to extend said solenoid shaft in order to positively restrain said release shaft from rotational motion and receiving yet another electrical signal to retract said solenoid shaft at said beginning of said brake application cycle to allow said rotational motion of said release shaft.

5. A release hold mechanism according to claim 1, wherein said release hold mechanism further includes an indicator member attached to said release shaft for indicating said hand brake is in said release hold position.

6. A release hold mechanism according to claim 5, wherein said indicator member includes a coating.

7. A release hold mechanism according to claim 6, wherein said coating is one of a reflective paint and a reflective tape.

8. A release hold mechanism according to claim 7, wherein said coating is said reflective tape.

9. In a hand brake for a railcar, where a hand wheel is used to rotate a gear wheel to apply brakes, with a chain winding drum and a main gear wheel rotatably mounted on a drum shaft thereon, a hand wheel shaft rotatably mounted on said housing at a first end and a having a hand wheel receiving section on a second end external to said housing, a ratchet wheel rotatable with said hand wheel shaft intermediate said first and second ends thereof, a holding pawl in said housing which cooperates with said ratchet wheel so as to prevent reverse rotation thereof, a freely rotatable second pinion gear on said hand wheel shaft and engaging said main gear wheel, said second pinion gear, a disengageable clutch collar between said second pinion gear and said ratchet wheel, a crank having fingers engageable with said clutch collar and a quick release mechanism which cooperates with said holding pawl and said crank to allow reverse rotation of said ratchet wheel for releasing said chain, the improvement comprising:

(a) a release hold mechanism for maintaining said quick release mechanism in a substantially release hold position to fully release brakes, said release hold mechanism for resetting said quick release mechanism to enable brake application; and (b) an indicator member attached to said quick release mechanism for indicating said hand brake is in a release hold position.

10. In a hand brake for railcar, according to claim 9, wherein said release hold mechanism includes:

(a) a release shaft rotatably disposed within said hand brake housing for rotation thereof;

(b) a release lever engaging said external end of said first shaft portion;

(c) a cam mounted on one end of said shaft, said cam having a force receiving portion, said cam further having a detent portion;

(d) a holding pawl rotatably coupled to said shaft, said holding pawl further having a ratchet engaging portion, said holding pawl additionally having a force transmitting portion cooperating with said force receiving portion of said cam; and (e) at least one detent means disposed within said hand brake, said at least one detent means engaging said detent portion of said cam to bias said cam in said release hold position for preventing an inadvertent application of the hand brake.

11. In a hand brake for railcar, according to claim 9, wherein said release hold mechanism includes:

(a) a release shaft rotatably disposed within said hand brake housing for rotation thereof;

(b) a release lever attached to said release shaft;

(c) a cam mounted on one end of said release shaft;

(d) a crank having a pair of fingers, said crank engageable with said cam during said hand brake release;

(e) a clutch collar engageable with said pair of fingers of said crank, said clutch collar having at least one detent release portion disposed thereon; and (f) at least one detent means disposed within said hand brake, said at least one detent means engaging a side surface of said clutch collar in said hand brake applied condition, said at least one detent means engaging a planar surface of said clutch collar in said hand brake release hold condition, said at least one detent means being disengageble by said at least one detent release portion of said clutch collar during rotation of said hand wheel to apply brakes.

12. In a hand brake for railcar, according to claim 9, wherein said release hold mechanism includes:

(a) a release shaft rotatably disposed within said hand brake housing for rotation thereof;

(b) a release lever attached to said release shaft;

(c) a cam mounted on one end of said release shaft;

(d) a crank having a pair of fingers, said crank engageable with said cam during said hand brake release;

(e) a clutch collar engageable with said pair of fingers of said crank, said clutch collar having at least one detent release portion disposed thereon; and (f) at least one detent means disposed within said hand brake, said at least one detent means engaging said pair of fingers of said crank in said hand brake applied condition, said at least one detent means being disengageble by said at least one detent release portion of said clutch collar during the rotation of said hand wheel to apply brakes.

13. In a hand brake for railcar, according to claim 9, wherein said release hold mechanism includes:

(a) a release shaft rotatably disposed within said hand brake housing for rotation thereof;

(b) a release lever attached to said release shaft;

(c) a cam mounted on one end of said shaft, said cam having a force receiving portion;

(d) a holding pawl rotatably coupled to said release shaft, said holding pawl having a ratchet engaging portion, said holding pawl further having a force transmitting portion cooperating with said force receiving portion of said cam;

(e) a crank having a pair of fingers, said crank engageable with said cam during said hand brake release;

(f) a clutch collar engageable with said pair of fingers of said crank, said clutch collar having at least one detent release portions disposed thereof; and (g) at least one detent means disposed within said hand brake;

(h) a ratchet wheel having at least one detent release portion disposed thereon, said at least one detent release portion engageable with said crank, said at least one detent release portion for disengaging said crank from said released hold position during rotation of said hand wheel to apply said brakes.

14. In a hand brake for railcar, according to claim 9, wherein said indicator member includes a coating.

15. In a hand brake for railcar, according to claim 14, wherein said coating is one of a reflective paint and reflective tape.

16. In a hand brake for railcar, according to claim 15, wherein said coating is said reflective tape.

17. In a hand brake for railcar, according to claim 9, wherein said hand brake further includes a brake governor having a governor gear, said brake governor coupled to at least one hand brake gear for applying a limited braking force, said limited braking force dependent upon the speed of rotation of said hand brake gear.

* * * * *